US011088485B2

(12) United States Patent
Tsukamoto

(10) Patent No.: US 11,088,485 B2
(45) Date of Patent: Aug. 10, 2021

(54) CONNECTOR AND ELECTRICAL CONNECTION DEVICE

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LIMITED, Osaka (JP)

(72) Inventor: Yuya Tsukamoto, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/977,031

(22) PCT Filed: Feb. 21, 2019

(86) PCT No.: PCT/JP2019/006531

§ 371 (c)(1),
(2) Date: Aug. 31, 2020

(87) PCT Pub. No.: WO2019/171970

PCT Pub. Date: Sep. 12, 2019

(65) Prior Publication Data

US 2021/0044049 A1 Feb. 11, 2021

(30) Foreign Application Priority Data

Mar. 7, 2018 (JP) ..... JP2018-040948

(51) Int. Cl.
*H01R 13/24* (2006.01)
*H01R 9/24* (2006.01)
(Continued)

(52) U.S. Cl.
CPC ..... *H01R 13/24* (2013.01); *H01R 9/24* (2013.01); *H01R 13/187* (2013.01); *H01R 13/447* (2013.01)

(58) Field of Classification Search
CPC H01R 13/2421; H01R 13/24; H01R 13/4538; H01R 9/24; H01R 13/447; H01R 13/187
See application file for complete search history.

(56) References Cited

U.S. PATENT DOCUMENTS 5,466,164 A 11/1995 Miyazaki et al.
7,736,202 B1 * 6/2010 Kaiser ..... H01R 13/2421 439/824

(Continued)

FOREIGN PATENT DOCUMENTS

JP H02-148573 U 12/1990
JP H05-033477 U 4/1993

(Continued)

OTHER PUBLICATIONS

Apr. 23, 2019 International Search Report issued in International Patent Application No. PCT/JP2019/006531.

*Primary Examiner* — Briggitte R. Hammond
(74) *Attorney, Agent, or Firm* — Oliff PLC

(57) ABSTRACT

A connector including a terminal having a flat facing surface facing a mating terminal of a mating connector; a resilient conductor provided to contact the facing surface, the resilient conductor being capable of contacting the mating terminal while being resiliently deformed in a direction orthogonal to the facing surface, the terminal being electrically connectable to the mating terminal via the resilient conductor, and a movable protecting body configured to be movable between a protection position that covers the facing surface on a front side in an assembling direction toward the mating terminal and a retracted position closer to the facing surface than the protection position, the movable protecting (Continued)

body including an insertion opening into which the resilient conductor is inserted at the retracted position, the resilient conductor projecting from the insertion opening being capable of contacting the mating terminal with the movable protecting body held at the retracted position.

8 Claims, 6 Drawing Sheets

(51) Int. Cl.
*H01R 13/187* (2006.01)
*H01R 13/447* (2006.01)

(56) References Cited

U.S. PATENT DOCUMENTS

| | | | | |
|---|---|---|---|---|
| 9,466,915 | B2 * | 10/2016 | Dilmaghanian | H01R 24/58 |
| 10,263,368 | B2 * | 4/2019 | Young | H01R 13/6583 |
| 2018/0375242 | A1 | 12/2018 | Nishida et al. | |
| 2019/0157788 | A1 | 5/2019 | Ando et al. | |
| 2019/0372260 | A1 | 12/2019 | Kimura et al. | |

FOREIGN PATENT DOCUMENTS

| | | | |
|---|---|---|---|
| JP | 2001-110509 | A | 4/2001 |
| JP | 2017-091835 | A | 5/2017 |
| JP | 2017-112031 | A | 6/2017 |
| JP | 2018-010826 | A | 1/2018 |
| JP | 2018-106819 | A | 7/2018 |
| JP | 2019-003759 | A | 1/2019 |

* cited by examiner

CONNECTOR AND ELECTRICAL CONNECTION DEVICE

BACKGROUND

The present disclosure relates to a connector and an electrical connection device.

In an electrical connection device for electrically connecting terminals provided in a pair of connectors by assembling the respective connectors with each other, a connection structure (referred to as a planar connection structure for convenience) for electrical conduction between the both terminals through a resilient conductive member (e.g. oblique coil spring) interposed in a compressed state between flat surfaces of the respective terminals by causing the flat surfaces to face each other is disclosed, for example, in Japanese Unexamined Patent Publication No. 2018-10826. In such a planar connection structure, it is not necessary to secure a fitting length of the terminals as compared to a fitting connection structure for fitting and connecting terminals of respective connectors to each other as a general connection structure. Thus, there is a merit of facilitating miniaturization of each connector in an assembling direction.

SUMMARY

The present inventor and other researchers studied how to prevent contact with a resilient conductive member and terminals from outside in a state where connectors are not assembled with each other in an electrical connection device having a planar connection structure as described above.

An exemplary aspect of the disclosure provides a connector and an electrical connection device capable of preventing contact with a resilient conductive member and terminals.

A connector according to an exemplary aspect of the disclosure includes a terminal having a flat facing surface facing a mating terminal of a mating connector; a resilient conductor provided to contact the facing surface, the resilient conductor being capable of contacting the mating terminal while being resiliently deformed in a direction orthogonal to the facing surface, the terminal being electrically connectable to the mating terminal via the resilient conductor, and a movable protecting body configured to be movable between a protection position that covers the facing surface on a front side in an assembling direction toward the mating terminal and a retracted position closer to the facing surface than the protection position, the movable protecting body including an insertion opening into which the resilient conductor is inserted at the retracted position, the resilient conductor projecting from the insertion opening being capable of contacting the mating terminal with the movable protecting body held at the retracted position.

According to the above aspect, the terminal of the connector and the mating terminal of the mating connector can be electrically connected by setting the movable protecting body at the retracted position when the connector is assembled with the mating connector. In a state where the connector is not assembled with the mating connector, contact with the resilient conductor and the terminal from outside can be prevented by setting the movable protecting body at the protection position.

In the above connector, the resilient conductor may be composed of a plurality of oblique coil springs provided along the facing surface and arranged in parallel to each other, and the insertion opening is composed of a plurality of insertion openings of the movable protecting body may be provided to respectively correspond to the plurality of oblique coil springs.

According to the above aspect, contact with the resilient conductor and the terminal from outside can be prevented by the movable protecting body in the connector using the plurality of oblique coil springs as the resilient conductor. Further, by using the oblique coil springs as the resilient conductor, foreign matters can be removed at contact points of the oblique coil springs and the terminal of the connector (and contact points of the oblique coil springs and the mating terminal).

The connector may further include a biasing spring that biases the movable protecting body in a direction separating from the facing surface and holding the movable protecting body at the protection position.

According to the above aspect, the movable protecting body can be suitably held at the protection position by the biasing spring, whereby contact with the resilient conductor and the terminal from outside can be suitably prevented.

An electrical connection device according to an exemplary aspect of the disclosure includes a first connector formed by the above connector, and a second connector including a second terminal having a contact surface facing the facing surface of the terminal of the first connector, the second connector being assembled with the first connector, the resilient conductor projecting from the insertion opening being capable of contacting the contact surface of the second terminal with the movable protecting body of the first connector located at the retracted position.

According to the above aspect, the terminal of the first connector and the terminal (second terminal) of the second connector can be electrically connected by setting the movable protecting body of the first connector at the retracted position when the first connector is assembled with the second connector in the electrical connection device having a planar connection structure. In a state where the first and second connectors are not assembled with each other, contact with the resilient conductor and the terminal from outside in the first connector can be prevented by setting the movable protecting body of the first connector at the protection position.

In the above electrical connection device, the second connector includes a second movable protecting body configured to be movable between a protection position for covering the contact surface of the second terminal on a front side in an assembling direction toward the first connector and a retracted position closer to the contact surface than the protection position, the second movable protecting body including a second insertion opening facing the insertion opening of the movable protecting body of the first connector in the assembling direction, and the movable protecting body of the first connector and the second movable protecting body are in contact with the each other and moved to the retracted positions thereof and the resilient conductor of the first connector is in contact with the contact surface of the second terminal through the insertion opening of the movable protecting body of the first connector and the second insertion opening of the second movable protecting body in an assembled state of the first and second connectors.

According to the above aspect, the terminal of the first connector and the terminal (second terminal) of the second connector can be electrically connected by setting the respective movable protecting bodies at the retracted positions when the first and second connectors are assembled with each other. Also in the second connector, contact with the second terminal from outside can be prevented by setting the second movable protecting body at the protection position in an unassembled state.

In the above electrical connection device, the resilient conductor may be composed of a plurality of oblique coil springs provided along the facing surface and arranged in parallel to each other, and the insertion opening may be composed of a plurality of insertion openings of the movable protecting body of the first connector and the second insertion opening is composed of a plurality of second insertion openings of the second movable protecting body that are provided to respectively correspond to the plurality of oblique coil springs.

According to the above aspect, contact with the terminals of the both first and second connectors from outside can be prevented by the respective movable protecting bodies in the electrical connection device using the plurality of oblique coil springs as the resilient conductor. Further, by using the oblique coil springs as the resilient conductor, foreign matters can be removed at contact points of the oblique coil springs and the respective terminals.

An electrical connection device according to an exemplary aspect of the disclosure includes a first connector; and a second connector, wherein: the first connector includes a first terminal having a flat facing surface and a resilient conductor provided to contact the facing surface, the second connector includes a second terminal facing the facing surface of the first terminal, the first terminal and the second terminal sandwich the resilient conductor and resiliently deform the resilient conductor in a direction orthogonal to the facing surface and are electrically connected to each other via the resilient conductor in an assembled state of the first and second connectors, the second terminal includes a contact projection projecting forward in an assembling direction with respect to the first connector, the second connector further includes a movable protecting body configured to be movable between a protection position for covering the second terminal on a front side in the assembling direction and a retracted position closer to the second terminal than the protection position, the movable protecting body including an insertion opening into which the contact projection is inserted at the retracted position, the first connector further includes a fixed protecting wall arranged on a side of the facing surface of the first terminal and configured to prevent contact with the resilient conductor and the first terminal from outside, and the fixed protecting wall is in contact with the movable protecting body and holds the movable protecting body at the retracted position and the contact projection projecting from the insertion opening is in contact with the resilient conductor in an assembled state of the first and second connectors.

According to the above aspect, the first and second terminals can be electrically connected by setting the movable protecting body of the second connector at the retracted position when the first connector is assembled with the second connector in the electrical connection device having a planar connection structure. In a state where the first and second connectors are not assembled with each other, contact with the resilient conductors and the first terminal from outside in the first connector is prevented by the fixed protecting wall and contact with the second terminal (contact projection) from outside is prevented by the movable protecting body set at the protection position in the second connector.

In the above electrical connection device, the resilient conductor may be composed of a plurality of oblique coil springs provided along the facing surface and arranged in parallel to each other, the fixed protecting wall may include protection walls arranged on both sides of each oblique coil spring in a juxtaposition direction, and the contact projection may be composed of a plurality of contact projections and the insertion opening may be composed of a plurality of insertion openings that may be provided to respectively correspond to the plurality of oblique coil springs.

According to the above aspect, contact with the first and second terminals from outside can be prevented in the electrical connection device using the plurality of oblique coil springs as the resilient conductor. Further, by using the oblique coil springs as the resilient conductor, foreign matters can be removed at contact points of the oblique coil spring and the respective terminals.

According to the connector and the electrical connection device of the present disclosure, it is possible to prevent contact with the resilient conductive body and the terminals.

DETAILED DESCRIPTION OF EMBODIMENTS

First Embodiment

Figure 1:
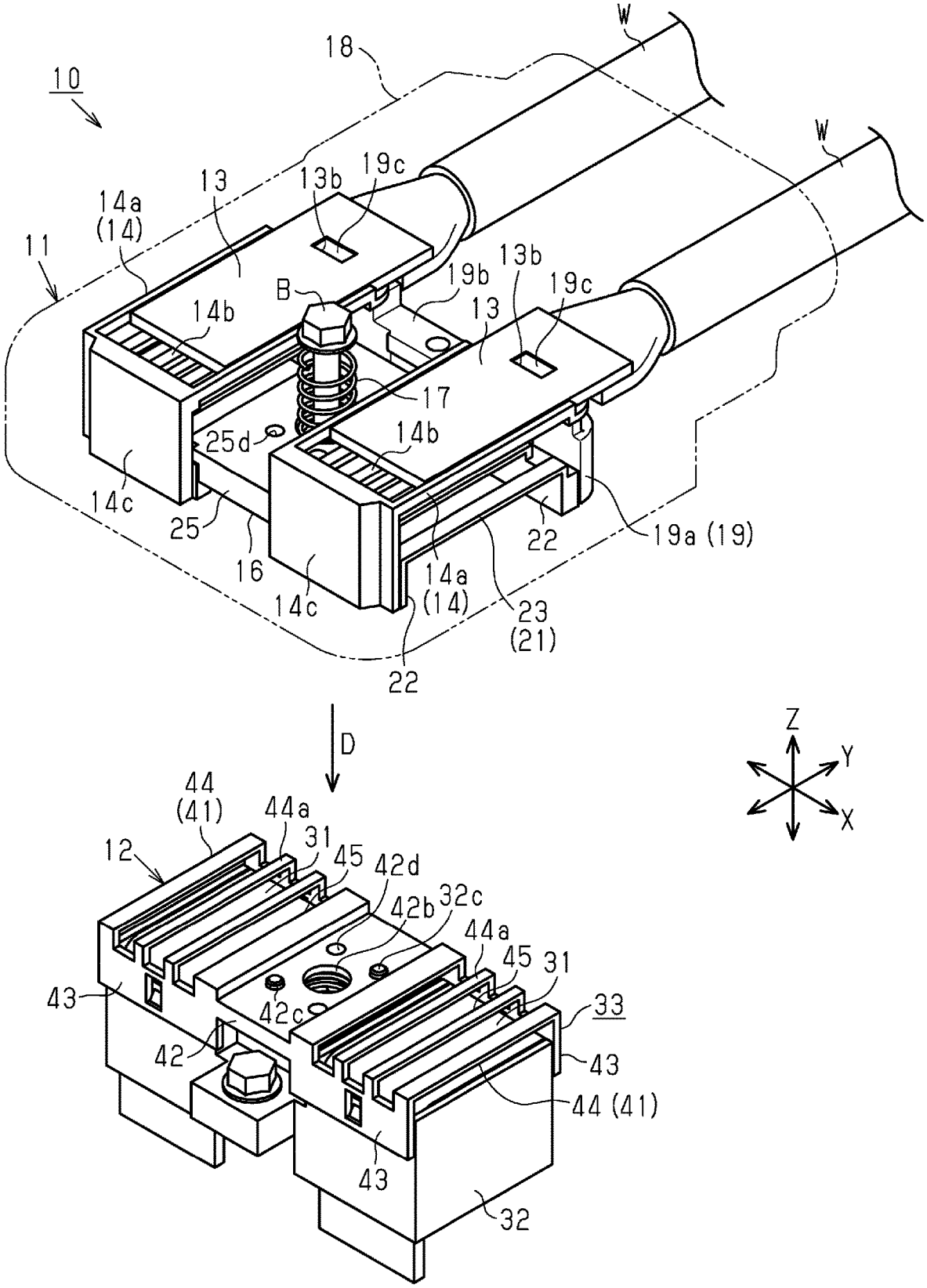
FIG. 1 is a perspective view showing a state before a first connector and a second connector are assembled in an electrical connection device of a first embodiment.

Hereinafter, a connector and an electrical connection device of a first embodiment are described with reference to the drawings. Note that, in the drawings, some configuration parts may be shown in an exaggerated or simplified manner for the convenience of description. Further, out XYZ axes in the drawings, the X axis represents a width direction of the electrical connection device, the Y axis represents a depth direction of the electrical connection device orthogonal to the X axis and the Z axis represents a height direction of the electrical connection device orthogonal to an XY plane.

As shown in FIG. 1, an electrical connection device 10 of this embodiment is used, for example, in a connection part in a wiring harness for a high-voltage power supply of a vehicle and includes a first connector 11 and a second connector 12 to be assembled with each other. Note that an assembling direction of the first connector 11 with respect to the second connector 12 is indicated by an arrow D in the drawings (hereinafter, referred to as the assembling direction D). Note that the assembling direction D indicates a relative assembling direction of the first connector 11 with respect to the second connector 12, and the second connector 12 is not limited as a fixed side. The second connector 12 may be assembled with the first connector 11 as a fixed side.

Further, the electrical connection device 10 of this embodiment has a planar connection structure in which flat surfaces (facing surfaces 13*a* and contact surfaces 31*a*) of first terminals 13 of the first connector 11 and second terminals 31 of the second connector 12 are arranged to face each other and the first and second terminals 13, 31 are made electrical conductive via oblique coil springs 15 serving as a resilient conductive member provided between the flat surfaces.

[Configuration of First Connector 11]

Figure 2:
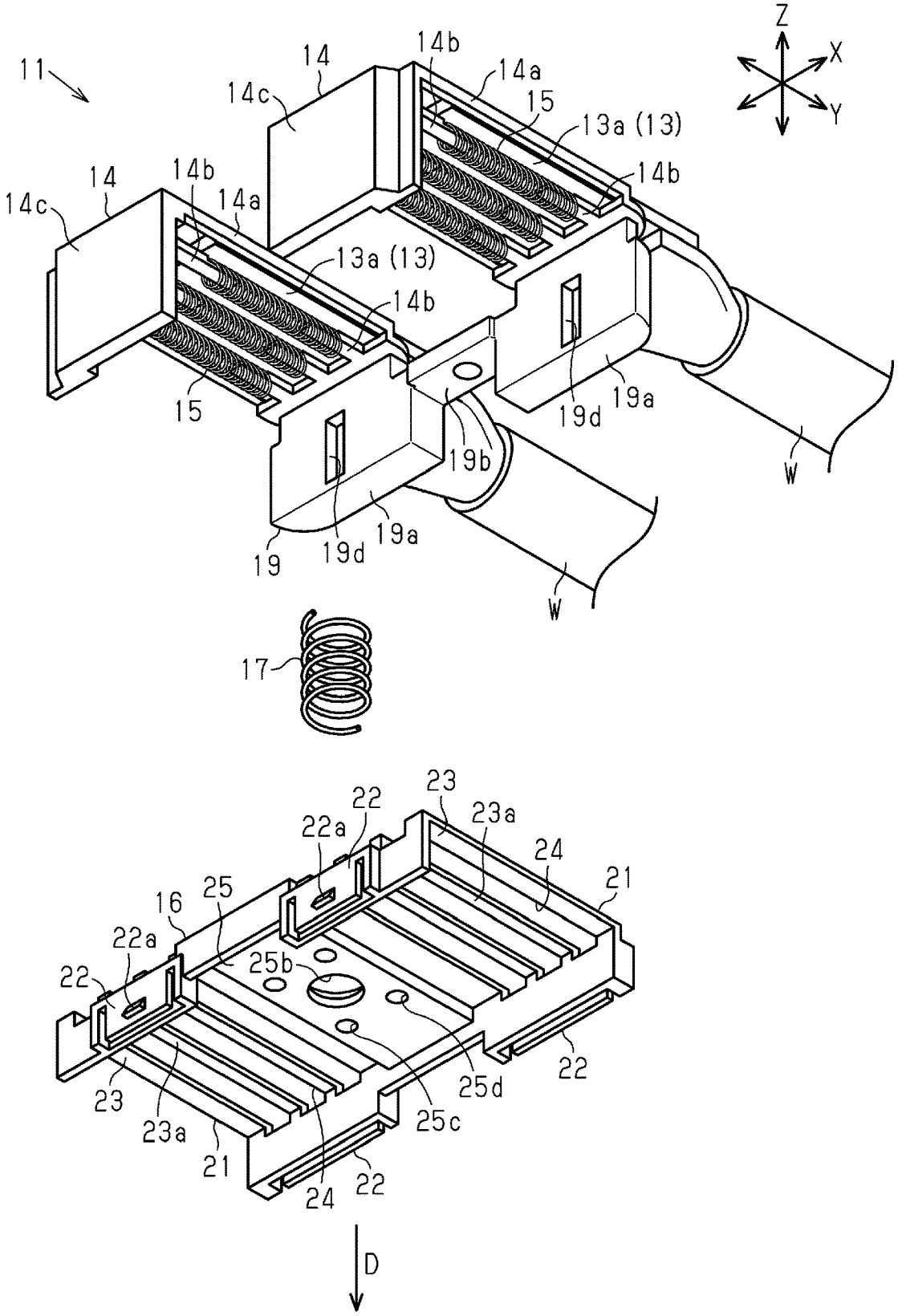
FIG. 2 is an exploded perspective view of some components of the first connector of the first embodiment.

As shown in FIGS. 1 and 2, the first connector 11 includes a pair of the first terminals 13 respectively connected to a pair of wires W, holding members 14 provided to correspond to the respective first terminals 13, the oblique coil springs 15 serving as the resilient conductive member (resilient conductor) and held in the respective holding members 14, and a first movable protecting member 16 (movable protecting body) for preventing contact with the oblique coil springs 15 and the first terminals 13. Further, the first connector 11 includes a first compression coil spring 17 serving as a biasing member for biasing the first movable protecting member 16. The first terminals 13, the holding members 14, the oblique coil springs 15, the first movable protecting member 16 and the first compression coil spring 17 are accommodated in a housing 18 (see FIG. 1) open on a front side in the assembling direction D toward the second connector 12. Note that the assembling direction D is a direction along the height direction (Z-axis direction) of the electrical connection device 10.

The pair of wires W are high-voltage wires, one of them is a plus-side wire and the other is a minus-side wire. Each wire W is pulled out from a base end side in the depth direction (Y-axis direction) in the housing 18. Further, plus-side and minus-side configurations of the first connector 11 (and the second connector 12 to be described later) arranged in the width direction (X-axis direction) are symmetrical with each other.

Figure 3:
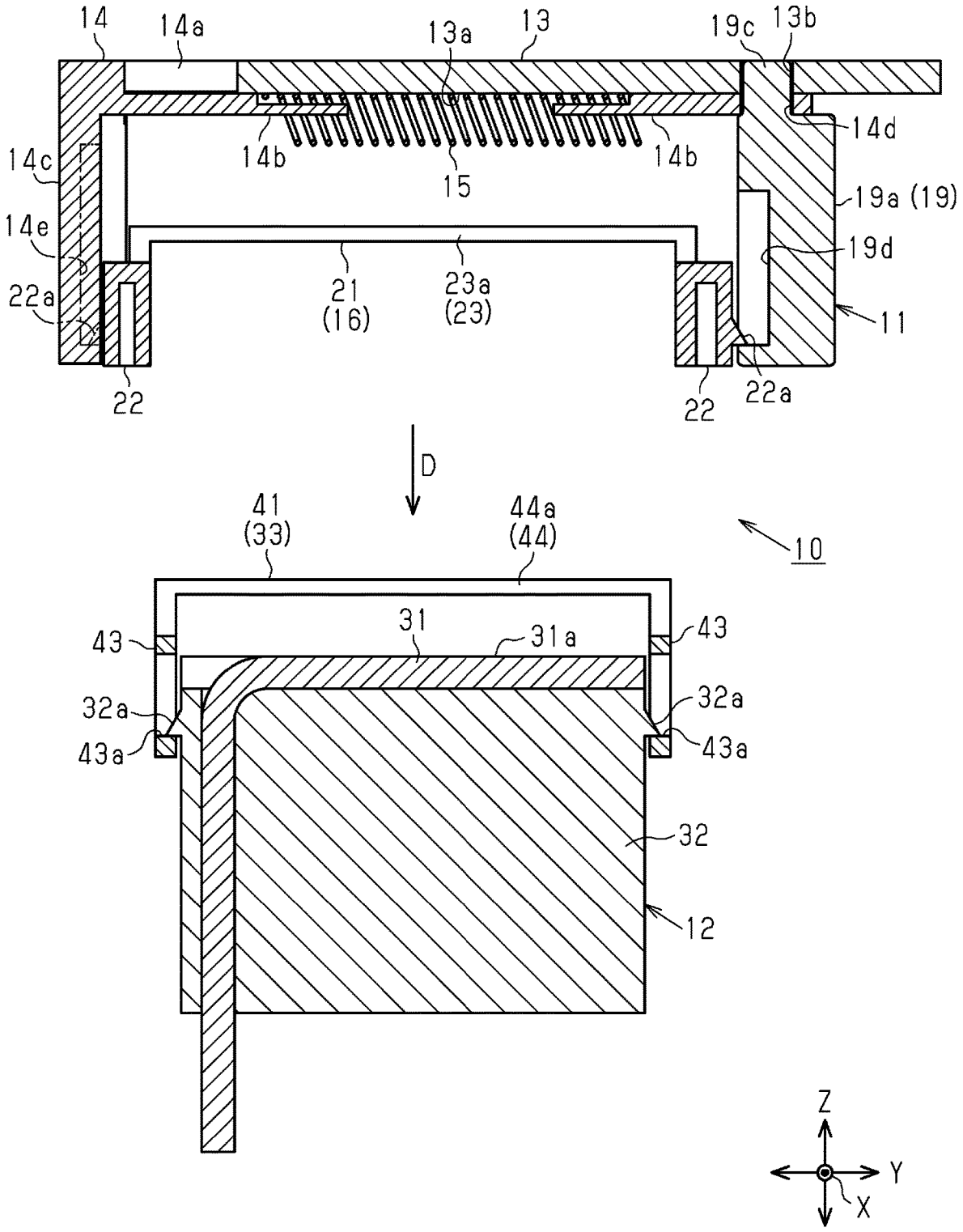
FIG. 3 is a section along YZ plane showing the state before the first and second connectors are assembled in the first embodiment.

Specific configurations of components of the first connector 11 are shown in FIGS. 1 to 4. Note that FIG. 3 is a section along 3-3 in FIG. 4. Further, the housing 18 is not shown in FIG. 2 and subsequent figures.

The first terminals 13 are plate-like and arranged to be orthogonal to the height direction (Z-axis direction). Further, the first terminals 13 have a rectangular shape long in the depth direction (Y-axis direction) in a plan view (Z-axis direction view). Note that the respective first terminals 13 are juxtaposed in the width direction (X-axis direction) at the same position in the height direction.

As shown in FIGS. 2 and 3, the oblique coil spring 15 is formed into a coil by winding a conductive wire material a plurality of times. The oblique coil spring 15 is a coil spring different from a general coil spring and wounded such that a winding surface of each coil section constituting the coil spring is oblique to a coil axis. If a load is applied from an axis orthogonal direction, the oblique coil spring 15 is so deformed that each winding surface is tilted to be further inclined with respect to the coil axis and reduce a dimension in the axis orthogonal direction. The oblique coil spring 15 has nonlinear regions where a spring load hardly changes even if a displacement amount in the axis orthogonal direction is changed.

Figure 4:
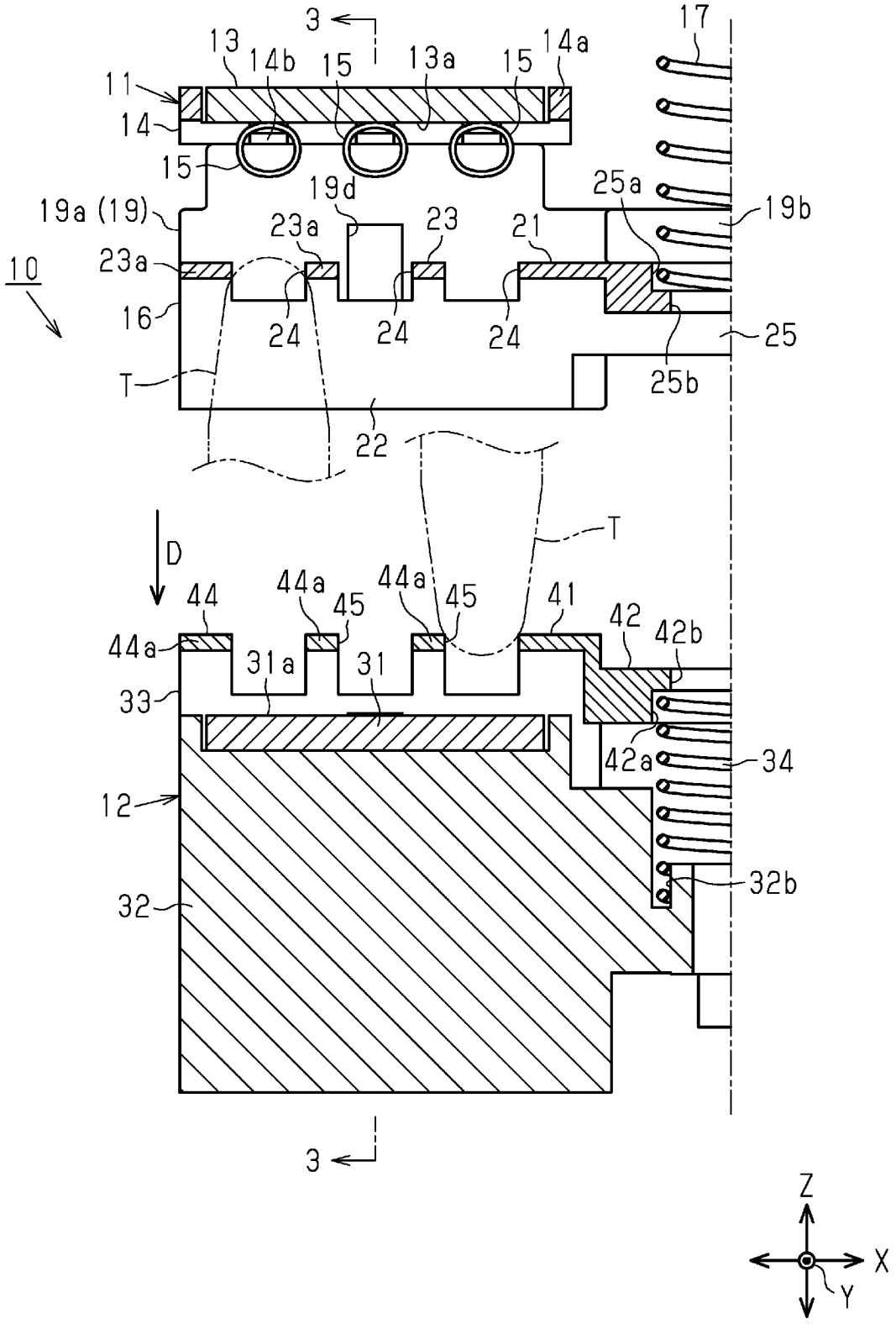
FIG. 4 is a section along XZ plane showing the state before the first and second connectors are assembled in the first embodiment.

As shown in FIGS. 2 to 4, three oblique coil springs 15 are provided to correspond to each first terminal 13. Specifically, the oblique coil spring 15 is provided in contact with the facing surface 13*a*, which is a plate surface of the first terminal 13 on a front side in the assembling direction D. Further, the oblique coil spring 15 is so provided that a longitudinal direction (coil axis direction) thereof extends along the Y-axis direction and three oblique coil springs 15 are provided side by side in the X-axis direction to correspond to each first terminal 13.

Each holding member 14 is made of a resin material. Each holding member 14 includes a frame portion 14*a* provided on a front side in the assembling direction D with respect to the first terminal 13. The frame portion 14*a* is provided with holding pieces 14*b* for holding the oblique coil springs 15 by being inserted into both longitudinal end parts of the oblique coil springs 15. Note that two holding pieces 14*b* are provided for one oblique coil spring 15. Further, each holding member 14 includes an extending wall 14*c* extending in the assembling direction D from a tip part in the Y-axis direction (end part opposite to a side toward which the wire W is pulled out) in the frame portion 14*a*. The extending wall 14*c* is substantially in the form of a plate orthogonal to the Y-axis direction.

Further, the first connector 11 of this embodiment includes a fixing member 19 made of resin for fixing the respective first terminals 13 and the respective holding members 14 to the housing 18. The fixing member 19 includes a pair of sandwiching portions 19*a* arranged on front sides in the assembling direction D of base end parts (end parts on the side of the wires W) in the Y-axis direction in the first terminals 13 and the holding members 14, and a fixing portion 19*b* formed to connect the pair of sandwiching portions 19*a*.

Each sandwiching portion 19*a* is facing the extending wall 14*c* of each holding member 14 in the Y-axis direction. Each sandwiching portion 19*a* is provided with a projecting portion 19*c* projecting rearward in the assembling direction D. The projecting portion 19*c* is fit into fitting holes 13*b*, 14*d* (see FIG. 3 and the like) respectively formed in the first terminal 13 and the frame portion 14*a*. By fixing the fixing portion 19*b* to the housing 18 by screwing or the like, the first terminals 13 and the frame portions 14*a* are sandwiched by the sandwiching portions 19*a* and the housing 18 in the height direction (Z-axis direction).

The first movable protecting member 16 is made of a resin material. The first movable protecting member 16 is held movably in the height direction by the extending walls 14*c* of the respective holding members 14 and the respective sandwiching portions 19*a* of the fixing member 19. The first movable protecting member 16 includes a pair of protecting member body portions 21 respectively corresponding to the pair of first terminals 13. Each protecting member body portion 21 is formed with a pair of side wall portions 22 facing each other in the Y-axis direction and a protecting portion 23 straddling between the pair of side wall portions 22. The protecting portion 23 is provided to cover the facing surface 13*a* of the first terminal 13 on a front side (lower side in figures) in the assembling direction D. Further, the protecting portion 23 includes as many slit-like insertion openings 24 extending in the Y-axis direction as the oblique coil springs 15 (three in this embodiment). The respective insertion openings 24 are facing the respective oblique coil springs 15 in the Z-axis direction. In other words, the protecting portion 23 includes extending portions 23*a* extending in the Y-axis direction on both sides of each insertion opening 24 in the width direction (X-axis direction). Each extending portion 23*a* is provided to straddle between the pair of side wall portions 22. Further, the respective extending portions 23*a* are configured to enter both sides of the respective oblique coil springs 15 in the X-axis direction with the first movable protecting member 16 located at a retracted position to be described later (see FIG. 6). Note that the respective extending portions 23*a* of this embodiment are in the form of plates orthogonal to the height direction.

As shown in FIG. 3, one of the pair of side wall portions 22 of the protecting member body portion 21 is arranged inwardly of the extending wall 14*c* of the holding member 14 in the Y-axis direction, and the other is arranged inwardly of the sandwiching portion 19*a* of the fixing member 19 in the Y-axis direction. A locking portion 22*a* projecting outward in the Y-axis direction is formed on the outer side surface of each side wall portion 22. The locking portion 22*a* of the one side wall portion 22 enters a guide groove 14*e* formed along the height direction in the inner side surface of the extending wall 14*c* of the holding member 14. The locking portion 22*a* of the other side wall portion 22 enters a guide groove 19*d* formed along the height direction in the inner side surface of the sandwiching portion 19*a* of the fixing member 19. Note that each locking portion 22*a* is formed to be resiliently deformable inwardly in the Y-axis direction when the first movable protecting member 16 is assembled.

As shown in FIGS. 2 and 4, the first movable protecting member 16 is formed with an intermediate portion 25 located between the pair of protecting member body portions 21. The intermediate portion 25 is formed with a spring accommodating portion 25*a* for accommodating one end part of the first compression coil spring 17 (see FIG. 4). The first compression coil spring 17 is so arranged that a coil axis thereof extends along the height direction, and configured to bias the first movable protecting member 16 forward in the assembling direction D. Particularly, one end in a coil axis direction of the first compression coil spring 17 is in contact with the spring accommodating portion 25*a*, the other end is in contact with the housing 18, and the spring accommodating portion 25*a* receives a biasing force of the first compression coil spring 17 acting forward in the assembling direction D.

Further, the spring accommodating portion 25*a* of the intermediate portion 25 is formed with a through hole 25*b* into which a bolt B (see FIG. 1) for fixing a shield cover (not shown) constituting the housing 18 is inserted. Note that the first compression coil spring 17 is externally fit on the bolt B, and the first compression coil spring 17 and the bolt B are arranged between the pair of first terminals 13. Further, shaft insertion holes 25*c* into which shaft portions (not shown) extending along the Z-axis direction from the housing 18 are formed around the spring accommodating portion 25*a* in the intermediate portion 25 (see FIG. 2). Note that the housing 18 is formed with a hollow cylindrical bolt insertion collar (not shown) into which the bolt B is inserted, and this bolt insertion collar functions as a fixing shaft for holding the first compression coil spring 17 by being inserted into the first compression coil spring 17.

The first movable protecting member 16 is configured to be movable between a protection position and the retracted position.

FIGS. 3 and 4 are views showing a state before the first connector 11 is assembled with the second connector 12, and show a state where the first movable protecting member 16 is at the protection position. As shown in FIGS. 3 and 4, at the protection position, the protecting portions 23 of the first movable protecting member 16 are located forward of the oblique coil springs 15 in the assembling direction D, and prevent external components, fingers and the like from contacting the facing surfaces 13*a* of the first terminals 13. Further, at the protection position, the respective locking portions 22*a* of the protecting member body portions 21 are locked to one end parts in the height direction of the respective guide grooves 14*e*, 19*d* (see FIG. 3). In this way, the first movable protecting member 16 biased in the assembling direction D by the first compression coil spring 17 is held at the protection position. The retracted position of the first movable protecting member 16 is a position reached by moving toward the first terminals 13 (upper side in figures) in the Z-axis direction from the protection position (see FIG. 5 and the like).

[Configuration of Second Connector 12]

As shown in FIGS. 1, 3 and 4, the second connector 12 includes a pair of the second terminals 31 juxtaposed in the width direction (X-axis direction), a base member 32 made of resin and holding the respective second terminals 31, a second movable protecting member 33 (second movable protecting body) assembled with the base member 32 and a second compression coil spring 34 serving as a biasing member for biasing the second movable protecting member 33. Note that, as described above, plus-side and minus-side configurations of the second connector 12 arranged in the width direction (X-axis direction) are symmetrical with each other. Further, the second compression coil spring 34 is arranged at a center position in the width direction (X-axis direction) of the second housing 12 between the pair of second terminals 31.

The respective second terminals 31 are plate-like and arranged to be orthogonal to the height direction (Z-axis direction). A surface of each second terminal 31 on an upper side in the height direction (side opposite to the base member) serves as the contact surface 31*a* with the first connector 11. Note that one end in the Y-axis direction of each second terminal 31 of this embodiment is bent substantially at a right angle.

The second movable protecting member 33 is made of a resin material. The second movable protecting member 33 includes a pair of protecting member body portions 41 respectively corresponding to the pair of second terminals 31 and an intermediate portion 42 located between the pair of protecting member body portions 41.

Each protecting member body portion 41 is formed with a pair of side wall portions 43 facing each other in the Y-axis direction and a protecting portion 44 straddling between the pair of side wall portions 43. The protecting portion 44 is provided to cover the contact surface 31*a* of the second terminal 31 on a side toward the first connector 11 (upper side in figures). Further, the protecting portion 44 includes slit-like insertion openings 45 extending in the Y-axis direction. The insertion openings 45 are provided to correspond to the respective insertion openings 24 of the first movable protecting member 16 (first connector 11). Specifically, the insertion openings 45 of the second movable protecting member 33 are as many as the insertion openings 24 of the first movable protecting member 16, and the respective insertion openings 24, 45 are configured to face each other in the height direction (Z-axis direction).

In other words, the protecting portion 44 includes extending portions 44*a* extending in the Y-axis direction on both sides of each insertion opening 45 in the width direction (X-axis direction). Each extending portion 44*a* is provided to straddle between the pair of side wall portions 43. In an assembled state of the first and second connectors 11, 12, the respective extending portions 44*a* of the second movable protecting member 33 are in contact with the respective extending portions 23*a* of the first movable protecting member 16 in the height direction (see FIG. 6). Further, in this assembled state, the respective extending portions 44*a* are configured to enter both sides of the respective oblique coil springs 15 in the X-axis direction. Note that the respective extending portions 44*a* of this embodiment are in the form of plates orthogonal to the height direction. Further, a width in the X-axis direction of each extending portion 44*a* is set equal to that of each extending portion 23*a* (first movable protecting member 16) in contact with each extending portion 44*a* in the assembled state.

As shown in FIG. 3, the pair of side wall portions 43 of the protecting member body portion 41 are respectively facing both side surfaces in the Y-axis direction of the base member 32. Each side wall portion 43 is formed with a long hole 43*a* extending in the height direction. Locking portions 32*a* respectively projecting from the both side surfaces in the Y-axis direction of the base member 32 enter the respective long holes 43*a*. Note that the respective side wall portions 43 are formed to be resiliently deformable outwardly in the Y-axis direction when the second movable protecting member 33 is assembled.

As shown in FIG. 4, the intermediate portion 42 of the second movable protecting member 33 is formed with a spring accommodating portion 42*a* for accommodating one end part of the second compression coil spring 34. The second compression coil spring 34 is so arranged that a coil axis thereof extends along the height direction. One end in a coil axis direction of the second compression coil spring 34 is in contact with the spring accommodating portion 42*a*, the other end is in contact with the spring accommodating portion 32*b* of the base member 32, and the second compression coil spring 34 biases the second movable protecting member 33 in a direction separating from the second terminals 31 (upward in figures). Further, in the assembled state of the first and second connectors 11, 12, the first and second compression coil springs 17, 34 are aligned with each other in the height direction (i.e. coaxially arranged).

The spring accommodating portion 42*a* of the intermediate portion 42 is formed with a through hole 42*b* into which the bolt B (see FIG. 1) is inserted in the assembled state of the first and second connectors 11, 12. Further, in the assembled state of the first and second connectors 11, 12, the bolt B is inserted in the second compression coil spring 34. Further, as shown in FIG. 1, a pair of shaft insertion holes 42*c* into which a pair of shaft portions 32*c* extending in the height direction from the base member 32 and a pair of shaft insertion holes 42*d* into which the shaft portions of the housing 18 are respectively inserted in the height direction in the assembled state of the first and second connectors 11, 12 are formed around the spring accommodating portion 42*a* in the intermediate portion 42. Note that a pair of shaft insertion holes 25*d* (only one is shown in FIG. 1) into which the pair of shaft portions 32*c* of the base member 32 are respectively inserted in the assembled state of the first and second connectors 11, 12 are formed around the spring accommodating portion 25*a* in the intermediate portion 25 of the first movable protecting member 16.

The second movable protecting member 33 of the second connector 12 is configured to be movable between a protection position and a retracted position.

FIGS. 3 and 4 show a state where the second movable protecting member 33 is at the protection position. As shown in FIGS. 3 and 4, at the protection position, the protecting portions 44 of the second movable protecting member 33 (protecting member body portions 41) are separated by a predetermined distance in the height direction (Z-axis direction) from the contact surfaces 31*a* of the second terminals 31. Specifically, the protecting portions 44 at the protection position cover the contact surfaces 31*a* of the second terminals 31 on a front side in an assembling direction toward the first connector 11, and prevent external components, fingers and the like from contacting the facing surfaces 31*a* of the second terminals 31. Further, at the protection position, the respective locking portions 32*a* of the base member 32 are locked to one end parts in the height direction of the respective long holes 43*a* of the protecting member body portions 41 (see FIG. 3). In this way, the second movable protecting member 33 biased in the direction separating from the second terminals 31 (upward in figures) by the second compression coil spring 34 is held at the protection position. The retracted position of the second movable protecting member 33 is a position reached by moving toward the second terminals 31 (lower side in figures) in the Z-axis direction from the protection position (see FIG. 5 and the like).

Figure 5:
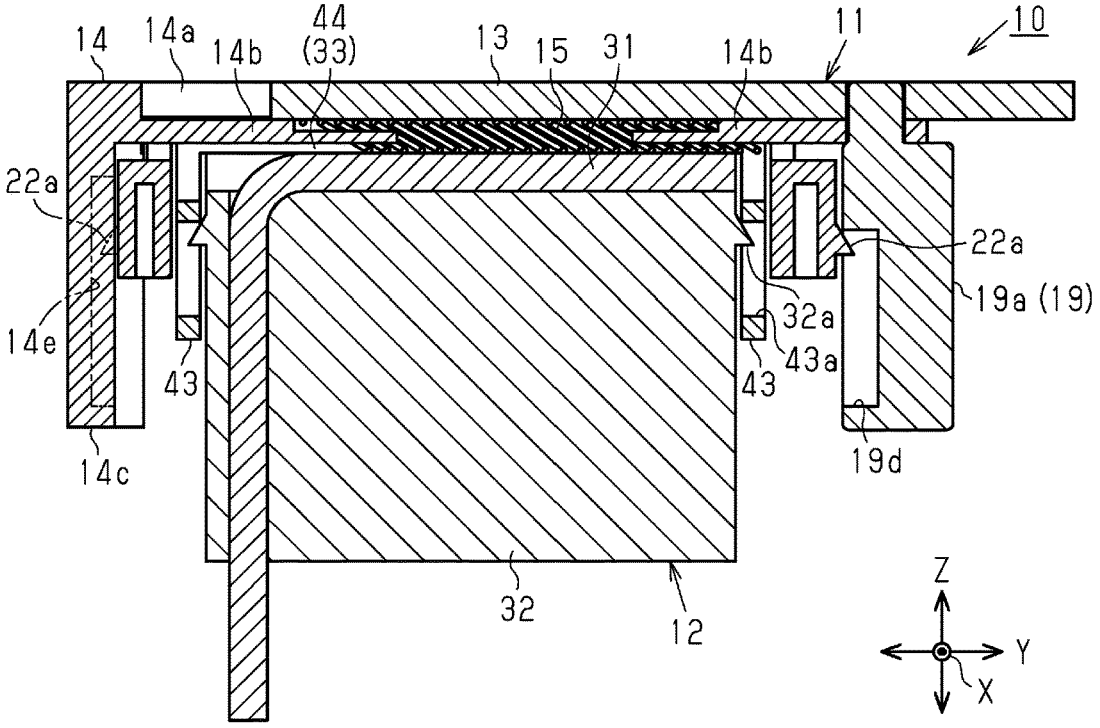
FIG. 5 is a section along YZ plane showing a state after the first and second connectors are assembled in the first embodiment.
Figure 6:
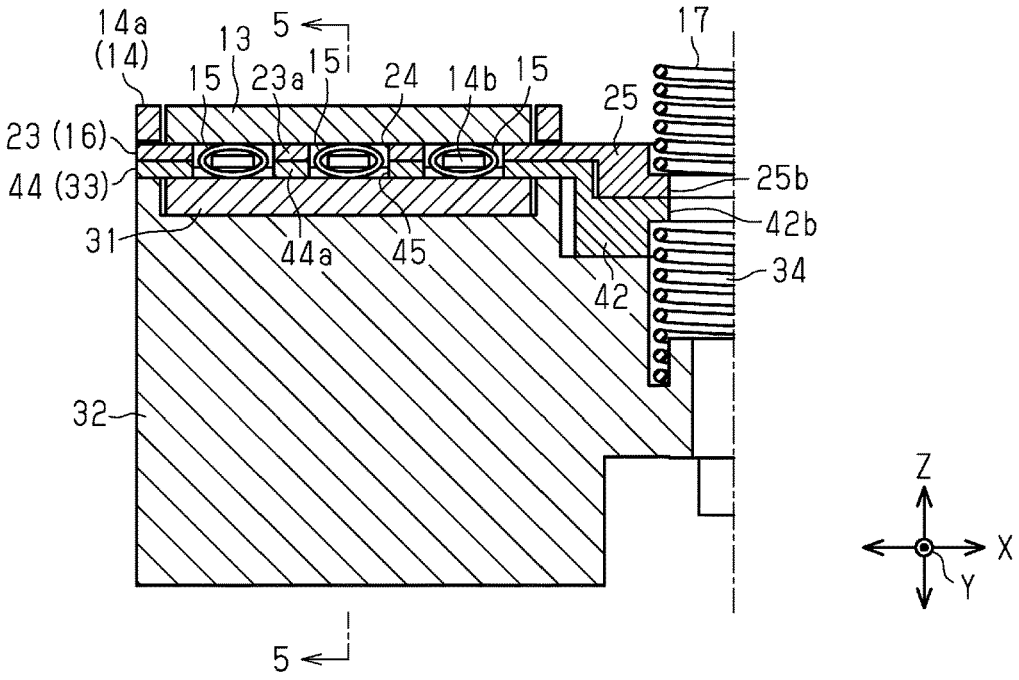
FIG. 6 is a section along XZ plane showing the state after the first and second connectors are assembled in the first embodiment.

FIGS. 5 and 6 are views showing a state where the first and second connectors 11, 12 are assembled with each other. Note that FIG. 5 is a section along 5-5 in FIG. 6. As shown in FIGS. 5 and 6, each of the first and second movable protecting members 16, 33 is located at the retracted position in the assembled state of the first and second connectors 11, 12.

The first and second connectors 11, 12 are so assembled that the facing surfaces 13*a* of the first terminals 13 and the contact surfaces 31*a* of the second terminals 31 approach each other with the facing surfaces 13*a* and the contact surfaces 31*a* set parallel to each other. At this time, the insertion openings 24, 45 in the respective protecting portions 23, 44 of the first and second movable protecting members 16, 33 are facing each other in the height direction, and the extending portions 23*a*, 44*a* of the protecting portions 23, 44 are in contact with each other in the height direction. Then, the first movable protecting member 16 is moved to the retracted position thereof against a biasing force of the first compression coil spring 17, and the second movable protecting member 33 is moved to the retracted position thereof against a biasing force of the second compression coil spring 34.

With each of the first and second movable protecting members 16, 33 located at the retracted position, the respective oblique coil springs 15 of the first connector 11 are interposed between the facing surfaces 13*a* of the first terminals 13 and the contact surfaces 31*a* of the second terminals 31 while being resiliently deformed (compressed) in the height direction. Specifically, the respective oblique coil springs 15 are brought into contact with both the facing surfaces 13*a* of the first terminals 13 and the contact surfaces 31*a* of the second terminals 31. In this way, the first terminals 13 and the second terminals 31 are made electrically conductive.

Note that the oblique coil spring 15 has a plurality of contact points with the first and second terminals 13, 31 in the coil axis direction (Y-axis direction). When the first and second connectors 11, 12 are assembled, the wire materials of the oblique coil springs 15 are tilted to have a steeper angle of inclination as an interval in the height direction between the first and second terminals 13, 31 becomes narrower (according to compression in the height direction). In that process, the plurality of contact points of the oblique coil springs 15 move in the coil axis direction (so-called wiping is performed). In this way, foreign matters between the oblique coil springs 15 and the first and second terminals 13, 31 can be removed.

Functions of this embodiment are described.

FIG. 4 shows test fingers T simulating the shape of a human finger based on safety standards by two-dot chain line. As shown in FIG. 4, in a state before the first connector 11 is assembled with the second connector 12, the protecting portions 23 of the first movable protecting member 16 are at the protection position forward of the oblique coil springs 15 in the assembling direction D. In this way, the intrusion of the test finger T toward the first terminals 13 is obstructed by the protecting portions 23. Similarly, in a state before the second connector 12 is assembled with the first connector 11, the protecting portions 44 of the second movable protecting member 33 are at the protection position separated by the predetermined distance in the height direction from the contact surfaces 31*a* of the second terminals 31. In this way, the intrusion of the test finger T toward the second terminals 31 is obstructed by the protecting portions 44. Note that the biasing forces (spring forces) of the first and second compression coil springs 17, 34 are for holding each of the first and second movable protecting members 16, 33 at the protection position, and set as forces of magnitudes based on the safety standards.

Effects of the first embodiment are described.

(1) The first connector 11 includes the first terminals 13 having the flat facing surfaces 13*a* facing the second terminals 31 (mating terminals), and the oblique coil springs 15 provided to contact the facing surfaces 13*a* and capable of contacting the second terminals 31 while being resiliently deformed in the direction orthogonal to the facing surfaces 13*a*. Further, the first connector 11 includes the first movable protecting member 16 configured to be movable between the protection position for covering the facing surfaces 13*a* on the front side in the assembling direction D toward the second terminals 31 and the retracted position closer to the facing surfaces 13*a* than at the protection position and including the insertion openings 24 for allowing the oblique coil springs 15 to be inserted therethrough and project forward in the assembling direction D at the retracted position. With the first movable protecting member 16 located at the retracted position, the oblique coil springs 15 projecting from the insertion openings 24 can contact the second terminals 31.

According to the above aspect, the first terminals 13 and the second terminals 31 can be electrically connected by setting the first movable protecting member 16 at the retracted position when the first connector 11 is assembled with the second connector 12. In a state where the first connector 11 is not assembled with the second connector 12, contact with the oblique coil springs 15 and the first terminals 13 from outside can be prevented by setting the first movable protecting member 16 at the protection position.

(2) The plurality of oblique coil springs 15 serving as the resilient conductive member are juxtaposed in parallel to each other along the facing surfaces 13*a*. The plurality of insertion openings 24 of the first movable protecting member 16 are provided to respectively correspond to the plurality of oblique coil springs 15. According to the above aspect, in the connector using the plurality of oblique coil springs 15 as the resilient conductive member, contact with the oblique coil springs 15 and the first terminals 13 from outside can be prevented by the first movable protecting member 16. Further, by using the oblique coil springs 15 as the resilient conductive member, foreign matters can be removed at the contact points of the oblique coil springs 15 and the first terminals 13 and the contact points of the oblique coil springs 15 and the second terminals 31.

(3) The first connector 1 includes the first compression coil spring 17 (biasing member) for biasing the first movable protecting member 16 in the direction separating from the facing surfaces 13*a* and holding the first movable protecting member 16 at the protection position. According to the above mode, the first movable protecting member 16 can be suitably held at the protection position by the first compression coil spring 17, whereby contact with the oblique coil springs 15 and the first terminals 13 from outside can be suitably prevented.

(4) The second connector 12 includes the second movable protecting member 33 configured to be movable between the protection position for covering the contact surfaces 31*a* on the front side in the assembling direction toward the first connector 11 (direction opposite to the assembling direction D) and the retracted position closer to the contact surfaces 31*a* than at the protection position. This second movable protecting member 33 includes the insertion openings 45 (second insertion openings) facing the insertion openings 24 of the first movable protecting member 16 in the assembling direction. In the assembled state of the first and second connectors 11, 12, the protecting portions 23, 44 (extending portions 23*a*, 44*a*) of the first and second movable protecting members 16, 33 are in contact with each other and moved to the retracted positions thereof, and the oblique coil springs 15 are brought into contact with the contact surfaces 31*a* of the second terminals 31 through the respective insertion openings 24, 45 of the first and second movable protecting members 16, 33.

According to the above aspect, the first terminals 13 and the second terminals 31 can be electrically connected by setting each of the first and second movable protecting members 16, 33 at the retracted position when the first connector 11 and the second connector 12 are assembled with each other. Also in the second connector 12, contact with the second terminals 31 from outside can be prevented by setting the second movable protecting member 33 at the protection position in an unassembled state.

Further, since the plurality of insertion openings 45 of the second movable protecting member 33 are also provided to respectively correspond to the plurality of oblique coil springs 15, contact with the second terminals 31 from outside can be prevented by the second movable protecting member 33 in the electrical connection device 10 using the plurality of oblique coil springs 15 as the resilient conductive member.

Second Embodiment

A second embodiment of the electrical connection device is described below in accordance with FIGS. 7 and 8. Note that, in this embodiment, components similar to those of the first embodiment are denoted by the same reference signs and not described in detail.

Figure 7:
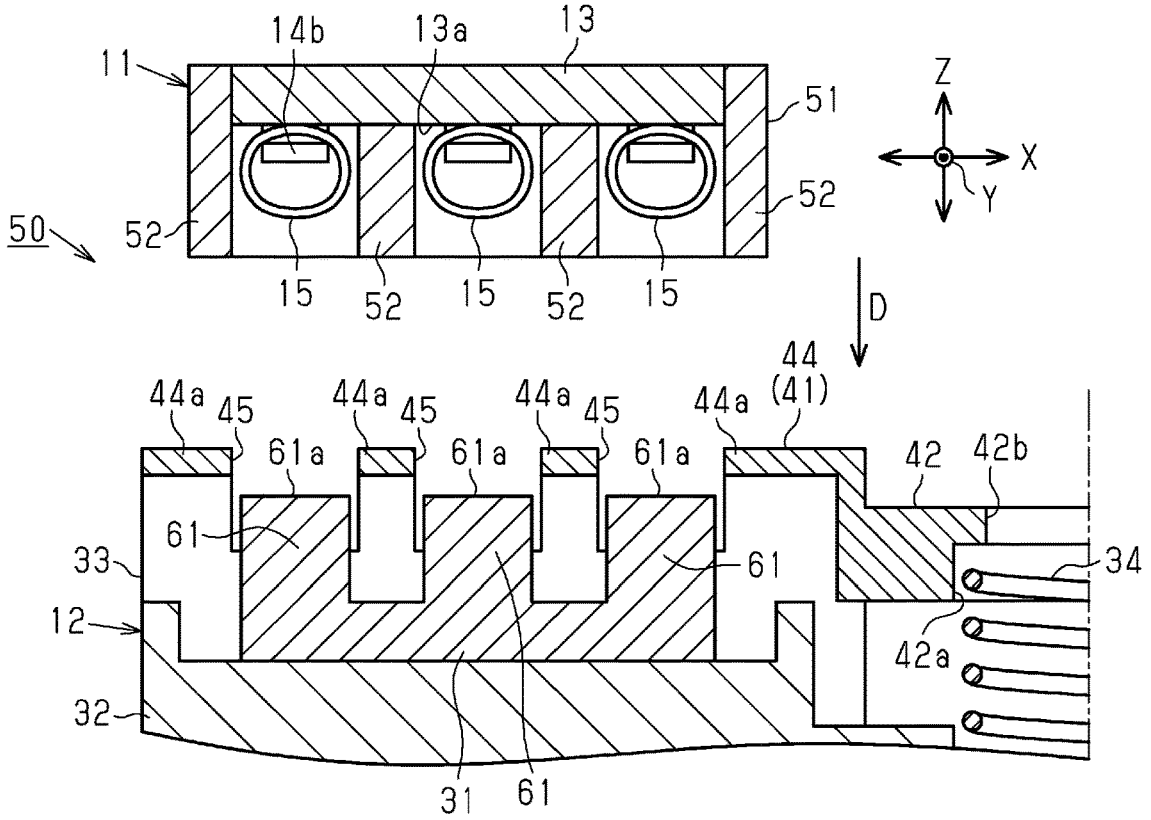
FIG. 7 is a section along XZ plane showing a state before a first connector and a second connector are assembled in a second embodiment.
Figure 8:
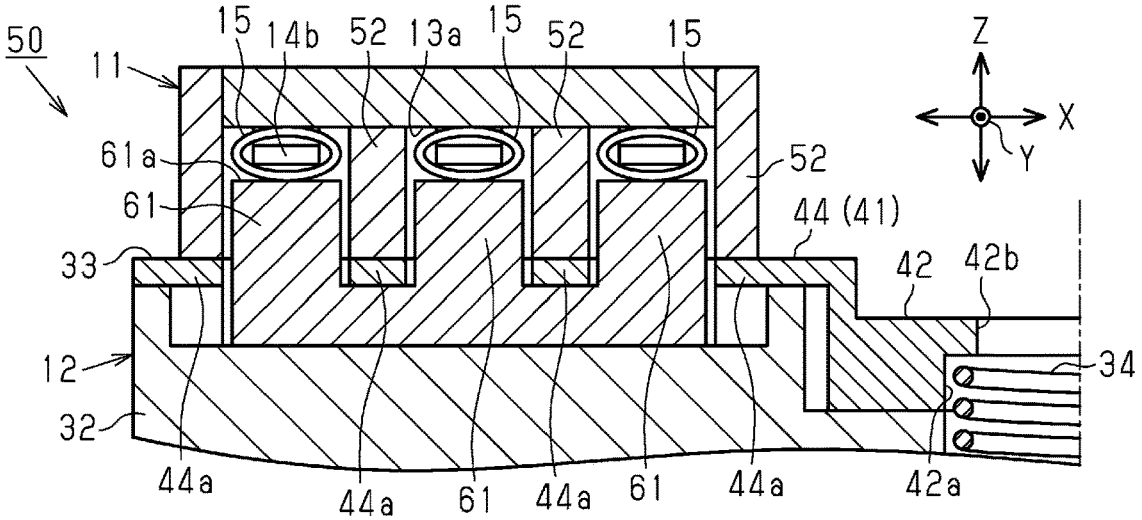
FIG. 8 is a section along XZ plane showing a state after the first and second connectors are assembled in the second embodiment.

As shown in FIG. 7, a first connector 11 of an electrical connection device 50 of this embodiment includes a fixed protecting member 51 (fixed protecting wall), which is a fixed component, instead of the first movable protecting member 16 of the first embodiment.

The fixed protecting member 51 is made of a resin material. The fixed protecting member 51 includes protection walls 52 located on both sides in a width direction (X-axis direction) of each oblique coil spring 15. Each protection wall 52 is a wall rising along an assembling direction D (Z-axis direction) with respect to a second connector 12, and located forward of first terminals 13 in the assembling direction D. A front end part (lower end part in FIG. 7) in the assembling direction D of each protection wall 52 is located forward (lower side in FIG. 7) of the oblique coil springs 15 in the assembling direction D. An interval in the width direction between the respective protection walls 52 is so set that the test fingers (see the first embodiment) based on the safety standards cannot touch the oblique coil springs 15. Further, the respective protection walls 52 are linearly formed along the Y-axis direction and a length thereof in the Y-axis direction is desirably longer than a length in a coil axis direction of the oblique coil springs 15. Note that the respective protection walls 52 of the fixed protecting member 51 can be integrally molded to the first terminals 13 by insert molding or the like. Further, holding pieces 14*b* for holding the oblique coil springs 15 can also be integrally molded to the fixed protecting member 51.

Second terminals 31 in the second connector 12 of this embodiment are formed with contact projections 61 projecting in an assembling direction (direction opposite to the assembling direction D) toward the first connector 11. As many contact projections 61 as the oblique coil springs 15 and insertion openings 45 of a second movable protecting member 33 (three in this embodiment) are provided. Further, the respective contact projections 61 are facing the respective insertion openings 45 on a front side in the assembling direction with respect to the first connector 11. Further, the front end surfaces of the respective contact projections 61 facing the first connector 11 are contact surfaces 61*a* to be brought into contact with the respective oblique coil springs 15, and the contact surfaces 61*a* are in the form of flat surfaces orthogonal to a height direction (Z-axis direction). Note that although the contact projections 61 are integrally formed on the second terminals 31 in this embodiment, there is no limitation to this and the contact projections 61 may be fixed to the second terminals 31 as members separate from the second terminals 31.

With the second movable protecting member 33 located at a protection position (see FIG. 7), extending portions 44*a* of protecting portions 44 are located forward of the contact surfaces 61*a* of the respective contact projections 61 in the assembling direction (assembling direction with respect to the first connector 11). In this way, external components, fingers and the like can be prevented from contacting the contact surfaces 61*a* of the respective contact projections 61 by the respective extending portions 44*a* of the protecting portions 44. Note that an interval in the width direction between the respective extending portions 44*a* (i.e. width of the insertion openings 45) is set equal to that between the respective protection walls 52.

When the first and second connectors 11, 12 in this embodiment are assembled, the respective protection walls 52 of the first connector 11 contact the corresponding extending portions 44*a* (second movable protecting member 33) in the height direction. Thus, as shown in FIG. 8, the second movable protecting member 33 is moved to the retracted position against a biasing force of the second compression coil spring 34.

When the second movable protecting member 33 is set at the retracted position, the respective contact projections 61 (contact surfaces 61*a*) of the second terminals 31 project further forward (upward in FIG. 8) than the protecting portions 44 (respective extending portions 44*a*) of the second movable protecting member 33 through the respective insertion openings 45. The respective contact projections 61 are inserted into between the respective protection walls 52 of the first connector 11 and the contact surfaces 61*a* thereof contact the oblique coil springs 15. Then, the respective oblique coil springs 15 of the first connector 11 are interposed between the facing surfaces 13*a* of the first terminals 13 and the contact surfaces 61*a* of the respective contact projections 61 while being resiliently deformed (compressed) in the height direction, whereby the first and second terminals 13, 31 are made electrically conductive via the respective oblique coil springs 15.

Effects of the second embodiment are described.

(5) The first connector 11 includes the fixed protecting member 51 arranged on the side of the facing surfaces 13*a* of the first terminals 13. Further, the second terminals 31 include the contact projections 61 projecting forward in the assembling direction with respect to the first connector 11 and to be inserted into the insertion openings 45 of the second movable protecting member 33 at the retracted position. In the assembled state of the first and second connectors 11, 12, the fixed protecting member 51 is in contact with the second movable protecting member 33 and holds the second movable protecting member 33 at the retracted position, and the contact projections 61 projecting from the insertion openings 45 are brought into contact with the oblique coil springs 15.

According to the above aspect, in the electrical connection device having a planar connection structure, the first terminals 13 and the second terminals 31 can be electrically connected by setting the second movable protecting member 33 at the retracted position when the first connector 11 is assembled with the second connector 12. In a state where the first connector 11 and the second connector 12 are not assembled, contact with the oblique coil springs 15 and the first terminals 13 from outside can be prevented by the fixed protecting member 51 in the first connector 11. Further, contact with the second terminals 31 (contact projections 61) from outside is prevented by the second movable protecting member 33 set at the protection position in the second connector 12.

(6) The fixed protecting member 51 includes the protection walls 52 arranged on both sides of each oblique coil spring 15 in a juxtaposition direction (X-axis direction). Further, the plurality of contact projections 61 and the plurality of insertion openings 45 are provided to respectively correspond to the plurality of oblique coil springs 15. In this way, contact with the first and second terminals 13, 31 from outside can be prevented in the electrical connection device 50 using the plurality of oblique coil springs 15 as a resilient conductive member.

The above respective embodiments can be modified as follows. The above respective embodiments and the following modifications can be combined with each other without technically contradicting each other.

In the first embodiment, a fixed protecting member, which is a fixed component, may be provided instead of the second movable protecting member 33. In this case, the fixed protecting member is configured such that the protecting portions 44 (respective extending portions 44*a*) of the first embodiment are fixed on the contact surfaces 31*a* of the second terminals 31. Also by this configuration, the first terminals 13 and the second terminals 31 can be electrically connected by setting the first movable protecting member 16 at the retracted position when the first connector 11 is assembled with the second connector 12. In the second connector 12 before assembly, contact with the contact surfaces 31*a* of the second terminals 31 from outside is prevented by the fixed protecting member.

In the above respective embodiments, the configuration of the holding pieces 14*b* for holding the oblique coil springs 15 is illustrative and can be, for example, changed such that the holding pieces 14*b* are inserted over the entire lengths of the oblique coil springs 15.

In the above respective embodiments, the holding members 14 (holding pieces 14*b*) may be omitted and the oblique coil springs 15 may be directly fixed to the facing surfaces 13*a* of the first terminals 13. In this case, it is considered to fix both end parts of the wire materials constituting the oblique coil springs 15 to the facing surfaces 13*a* of the first terminals 13 by welding, bonding or the like.

The number of the oblique coil springs 15 in the above respective embodiments is illustrative and one, two, four or more oblique coil springs 15 may be provided for one first terminal 13. Of course, it is desirable to appropriately change the numbers of the insertion openings 24, 45, the protection walls 52, the contact projections 61 and the like according to the number of the oblique coil springs 15.

In the above respective embodiments, each oblique coil spring 15 is so provided that the coil axis extends in the depth direction (Y-axis direction). Besides this, each oblique coil spring 15 may be, for example, so provided that the coil axis extends along the width direction (X-axis direction).

Although the resilient conductive member to be interposed in a resiliently deformed state between the first and second terminals 13, 31 is composed of the oblique coil springs 15 in the above respective embodiments, there is no particular limitation to this. For example, metal plate members including a plurality of cut-and-raised portions along an extending direction (Y-axis direction) of the insertion openings 24 (or protection walls 52) may be fixed to the facing surfaces 13*a* of the first terminals 13, and the respective cut-and-raised portions may resiliently contact (contact while being resiliently deformed in the height direction) the second terminals 31.

Although one first compression coil spring 17 and one second compression coil spring 34 are provided in the first embodiment, two or more first compression coil springs and two or more second compression coil springs may be provided. Further, two or more second compression coil spring 34 may be similarly provided also in the second embodiment.

In the first embodiment, the first compression coil spring 17 is arranged between the first terminal 13 on the plus side and the first terminal 13 on the minus side. However, besides this, biasing members such as compression coil springs may be respectively provided near both widthwise end parts of the first movable protecting member 16 so that the first movable protecting member 16 can be stably held at the protection position. Further, the arranged positions of the second compression coil springs 34 can also be similarly changed in the above respective embodiments.

In the first embodiment, biasing members other than the first and second compression coil springs 17, 34 may be used if these biasing members can apply biasing forces acting toward the respective protection positions to the first and second movable protecting members 16, 33. Note that the second compression coil spring 34 can be similarly changed to another biasing member also in the second embodiment.

In the first embodiment, the biasing members (first and second compression coil springs 17, 34) for the first and second movable protecting members 16, 33 can be omitted if each of the first and second movable protecting members 16, 33 is held at the protection position by a locking structure or the like. Further, the second movable protecting member 33 can be similarly omitted also in the second embodiment.

The shapes of the first and second terminals 13, 31 and the like are illustrative in the above respective embodiments, and can be appropriately changed according to the configurations.

Technical concepts which can be grasped from the above respective embodiments and modifications are described.

The electrical connection device is provided with the second connector including a fixed protecting member arranged to face the contact surfaces of the second terminals and configured to prevent contact with the second terminals from outside, and the fixed protecting member of the second connector is in contact with the first movable protecting member (movable protecting member of the first connector) and holds the first movable protecting member at the retracted position and the resilient conductive member is in contact with the contact surfaces of the second terminals through the insertion openings of the first movable protecting member in the assembled state of the first and second connectors.

According to the above aspect, in the electrical connection device having a planar connection structure, the first and second terminals can be electrically connected by setting the first movable protecting member at the retracted position when the first connector is assembled with the second connector. In the state where the first and second connectors are not assembled, contact with the resilient conductive member and the first terminals from outside is prevented by the first movable protecting member set at the protection position in the first connector and contact with the second terminals from outside is prevented by the fixed protecting member in the second connector.

It would be apparent to a person skilled in the art that the present disclosure may be embodied in other specific forms without departing from the technical concept thereof. For example, some of the components described in the embodiments (or one or more aspects thereof) may be omitted or several components may be combined.

The invention claimed is:

1. A connector, comprising:

a terminal having a flat facing surface facing a mating terminal of a mating connector;

a resilient conductor provided to contact the facing surface, the resilient conductor being capable of contacting the mating terminal while being resiliently deformed in a direction orthogonal to the facing surface, the terminal being electrically connectable to the mating terminal via the resilient conductor, and a movable protecting body configured to be movable between a protection position that covers the facing surface on a front side in an assembling direction toward the mating terminal and a retracted position closer to the facing surface than the protection position, the movable protecting body including an insertion opening into which the resilient conductor is inserted at the retracted position, the resilient conductor projecting from the insertion opening being capable of contacting the mating terminal with the movable protecting body held at the retracted position.

2. A connector according to claim 1, wherein:

the resilient conductor is composed of a plurality of oblique coil springs provided along the facing surface and arranged in parallel to each other, and the insertion opening is composed of a plurality of insertion openings of the movable protecting body that are provided to respectively correspond to the plurality of oblique coil springs.

3. A connector according to claim 1, further comprising a biasing spring that biases the movable protecting body in a direction separating from the facing surface and holding the movable protecting body at the protection position.

4. An electrical connection device, comprising:

a first connector formed by the connector according to claim 1; and a second connector including a second terminal having a contact surface facing the facing surface of the terminal of the first connector, the second connector being assembled with the first connector, the resilient conductor projecting from the insertion opening being capable of contacting the contact surface of the second terminal with the movable protecting body of the first connector located at the retracted position.

5. An electrical connection device according to claim 4, wherein:

the second connector includes a second movable protecting body configured to be movable between a protection position for covering the contact surface of the second terminal on a front side in an assembling direction toward the first connector and a retracted position closer to the contact surface than the protection position, the second movable protecting body including a second insertion opening into which the resilient conductor of the first connector is inserted, and the movable protecting body of the first connector and the second movable protecting body are in contact with the each other and moved to the retracted positions thereof and the resilient conductor of the first connector is in contact with the contact surface of the second terminal through the insertion opening of the movable protecting body of the first connector and the second insertion opening of the second movable protecting body in an assembled state of the first and second connectors.

6. An electrical connection device according to claim 5, wherein:

the resilient conductor is composed of a plurality of oblique coil springs provided along the facing surface and arranged in parallel to each other, and the insertion opening is composed of a plurality of insertion openings of the movable protecting body of the first connector and the second insertion opening is composed of a plurality of second insertion openings of the second movable protecting body that are provided to respectively correspond to the plurality of oblique coil springs.

7. An electrical connection device, comprising a first connector; and a second connector, wherein:

the first connector includes a first terminal having a flat facing surface and a resilient conductor provided to contact the facing surface, the second connector includes a second terminal facing the facing surface of the first terminal, the first terminal and the second terminal sandwich the resilient conductor and resiliently deform the resilient conductor in a direction orthogonal to the facing surface and are electrically connected to each other via the resilient conductor in an assembled state of the first and second connectors, the second terminal includes a contact projection projecting forward in an assembling direction with respect to the first connector, the second connector further includes a movable protecting body configured to be movable between a protection position for covering the second terminal on a front side in the assembling direction and a retracted position closer to the second terminal than the protection position, the movable protecting body including an insertion opening into which the contact projection is inserted at the retracted position, the first connector further includes a fixed protecting wall arranged on a side of the facing surface of the first terminal and configured to prevent contact with the resilient conductor and the first terminal from outside, and the fixed protecting wall is in contact with the movable protecting body and holds the movable protecting body at the retracted position and the contact projection projecting from the insertion opening is in contact with the resilient conductor in an assembled state of the first and second connectors.

8. An electrical connection device according to claim 7, wherein:

the resilient conductor is composed of a plurality of oblique coil springs provided along the facing surface and arranged in parallel to each other, the fixed protecting wall includes protection walls arranged on both sides of each oblique coil spring in a juxtaposition direction, and the contact projection is composed of a plurality of contact projections and the insertion opening is composed of a plurality of insertion openings that are provided to respectively correspond to the plurality of oblique coil springs.

* * * * *